US006878888B1

(12) United States Patent
Jong

(10) Patent No.: US 6,878,888 B1
(45) Date of Patent: Apr. 12, 2005

(54) SAFETY DEVICE FOR ACTIVATING ELECTRIC TOOLS

(75) Inventor: Jung-Chang Jong, Chungli (TW)

(73) Assignee: Jenn Peng Industrial Co., Ltd., Taoyuan (TW)

( * ) Notice: Subject to any disclaimer, the term of this patent is extended or adjusted under 35 U.S.C. 154(b) by 0 days.

(21) Appl. No.: 10/809,779

(22) Filed: Mar. 24, 2004

(51) Int. Cl.[7] ..... B27B 17/02; H01H 9/28

(52) U.S. Cl. ..... 200/43.17; 200/322; 200/332.2; 30/381; 30/382

(58) Field of Search ..... 200/43.01, 43.11, 200/43.16, 43.17, 522, 318, 320–322, 332.2, 334; 30/381–383

(56) References Cited

U.S. PATENT DOCUMENTS 4,782,593 A * 11/1988 Kieser et al. ..... 30/382
5,101,567 A * 4/1992 Cool ..... 30/382
5,638,945 A 6/1997 Fukinuki et al. ..... 200/43.17
5,724,737 A 3/1998 Stones ..... 30/228
5,791,057 A * 8/1998 Nakamura et al. ..... 30/381
5,969,312 A * 10/1999 Svetlik et al. ..... 200/61.85
6,169,258 B1 1/2001 Roney et al. ..... 200/332.2
6,469,269 B1 10/2002 Jong ..... 200/522
6,548,776 B1 4/2003 Jong ..... 200/334

* cited by examiner

*Primary Examiner*—Michael A. Friedhofer

(57) ABSTRACT

A safety device includes a trigger for activating a first switch and a brake device for braking the output shaft of the electric tool. The trigger is controlled by a safety button that pivots a pivotal member that is engaged with a rotatable member when an intermediate member of the brake device is shifted by operating the brake device. The rotatable member matched with the pivotal member is rotated to activate a second switch. The electric power is provided to the output shaft when both the first and second switches are activated.

4 Claims, 11 Drawing Sheets

SAFETY DEVICE FOR ACTIVATING ELECTRIC TOOLS

FIELD OF THE INVENTION

The present invention relates to a safety device including a trigger and a brake device. The electric tool can only be activated when both of the trigger and the brake device are operated.

BACKGROUND OF THE INVENTION

A conventional electric device generally includes a trigger, which is electrically connected to the power source such that when the user pulls the trigger, the electric power is provided to the output shaft that is connected to a drill or a saw blade. Nevertheless, there is a potential risk of injury for the users or the object to be machined if the trigger is unintentionally pulled. Once the trigger is pulled, the output shaft immediately rotates at high speed and injury cannot be avoided. Some electric tools have a safety device that simply restricts the trigger from being pulled, if the safety device is unlocked or the user forgot to lock it, the tool can be activated by anyone.

Therefore, it is desired to have a safety device that is cooperated with a brake device. The trigger is pulled to introduce the electric power to drive the output shaft only when the output shaft is braked by operating the brake device.

SUMMARY OF THE INVENTION

In accordance with an aspect of the present invention, there is provided a safety device for an electric tool that includes a casing having a handle, a power source device for providing electric power to an output shaft. The safety device comprises a trigger pivotably connected to the handle and may activate a first switch when the trigger is pulled. A safety button is movably connected to the casing and has a protrusion so as to stop the trigger from being pulled. A push rod has a fist end connected to the safety button and the other end of the push rod is pivotably connected to pivotal member that has a ridge extending from a surface thereof. A rotatable member is pivotably connected to an inside of the casing and has an arm extending from the rotatable member so as to activate a second switch when the rotatable member is rotated. A groove is defined in a surface of the rotatable member and sized to receive the ridge of the pivotal member. A spring is connected to the other surface of the pivotal member so as to push the pivotal member toward the rotatable member.

An intermediate member is sandwiched between the pivotal member and the rotatable member. An inclined surface is defined in a surface of the intermediate member and the pivotal member 25 is pressed on the inclined surface. An end of the intermediate member is connected to a brake device that is pivotably connected to the casing so as to brake the output shaft. The inclined surface of the intermediate member is shifted relative to the pivotal member when the brake device is pivoted, so that the ridge of the pivotal member can be engaged with the groove of the rotatable member.

The present invention will become more obvious from the following description when taken in connection with the accompanying drawings, which show, for purposes of illustration only, a preferred embodiment in accordance with the present invention.

DETAILED DESCRIPTION OF THE PREFERRED EMBODIMENT

Figure 1:
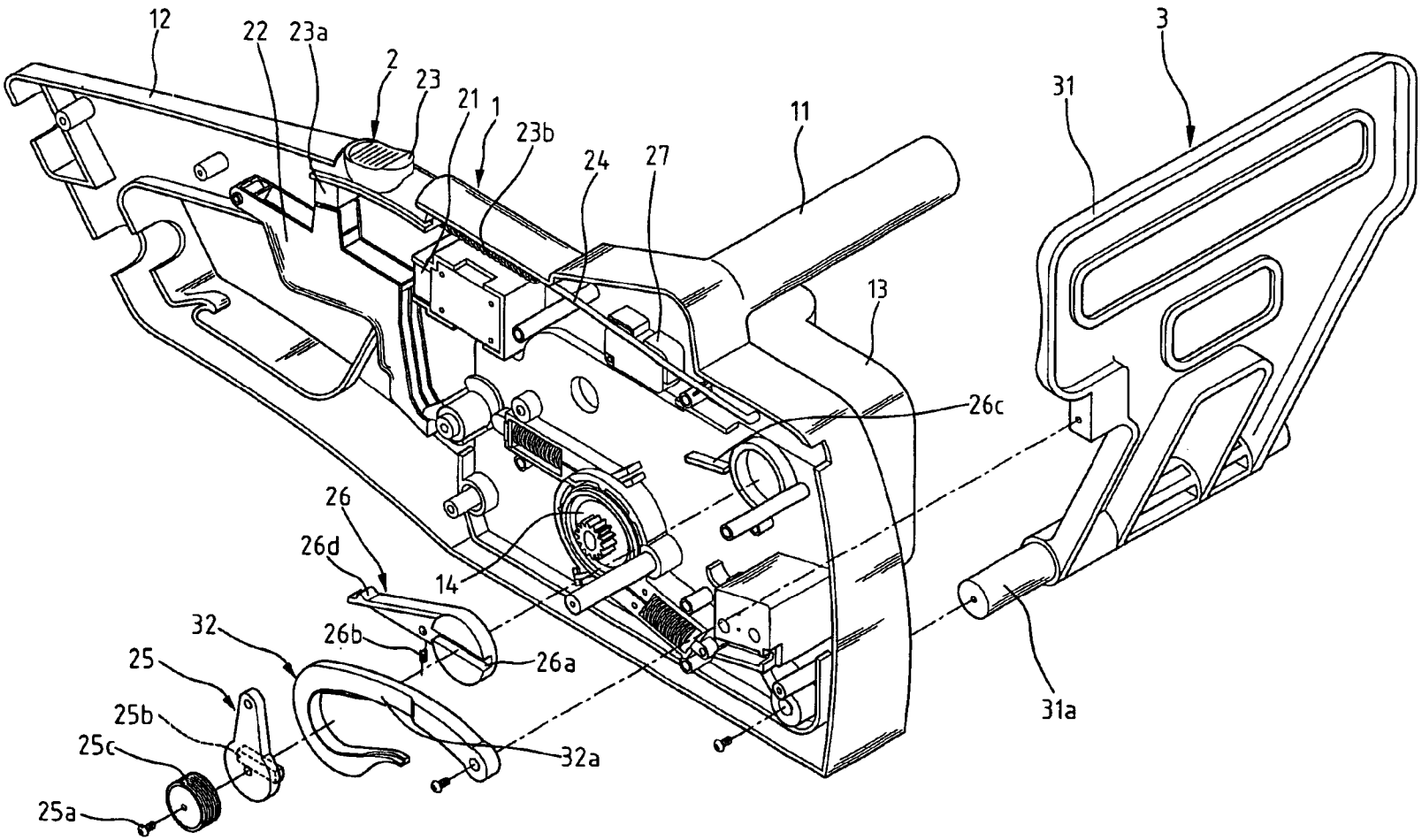
FIG. 1 is an exploded view of a safety device in accordance with the present invention.
Figure 2:
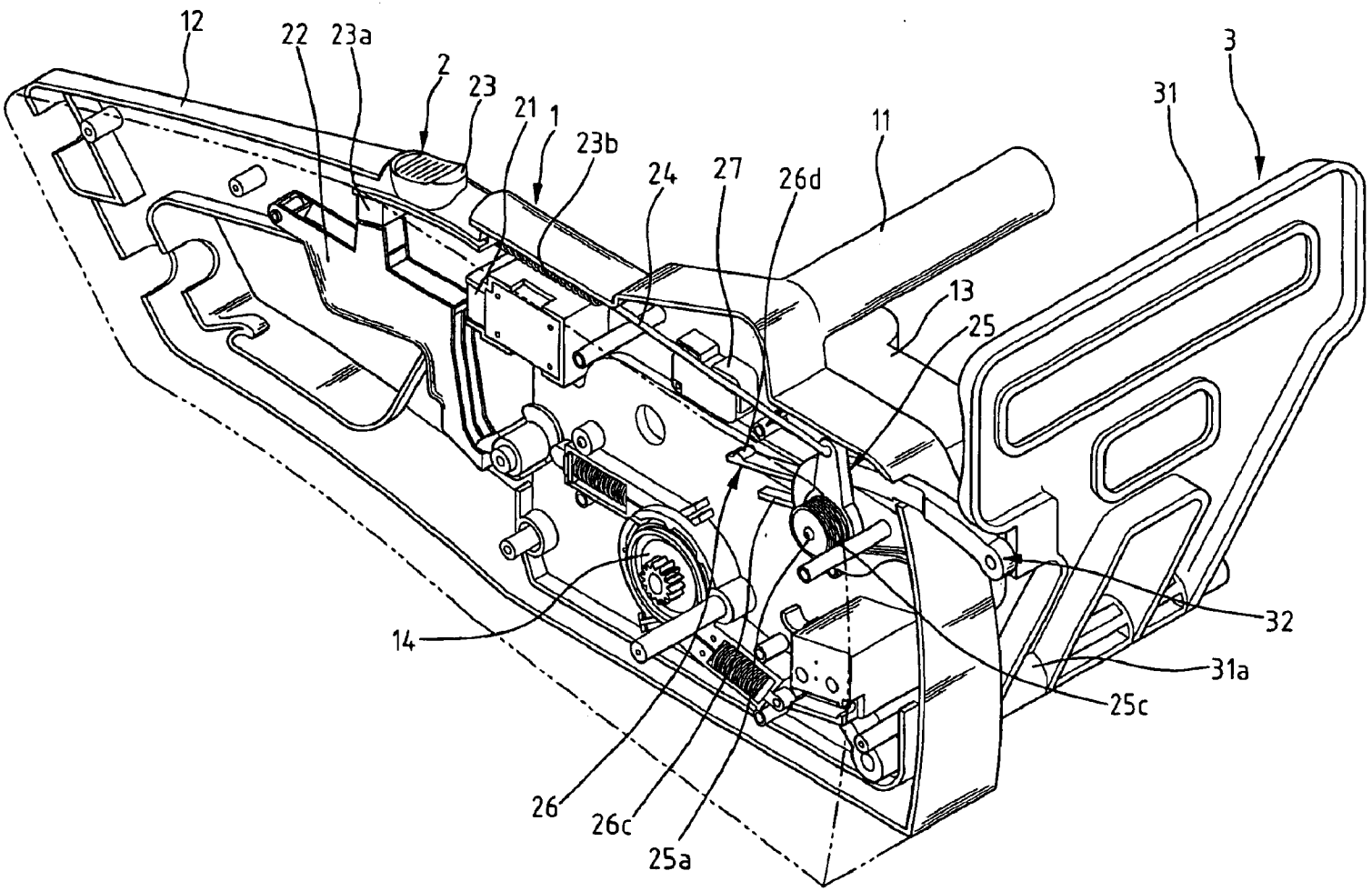
FIG. 2 is a perspective view to show the safety device in accordance with the present invention connected to the electric tool.
Figure 3:
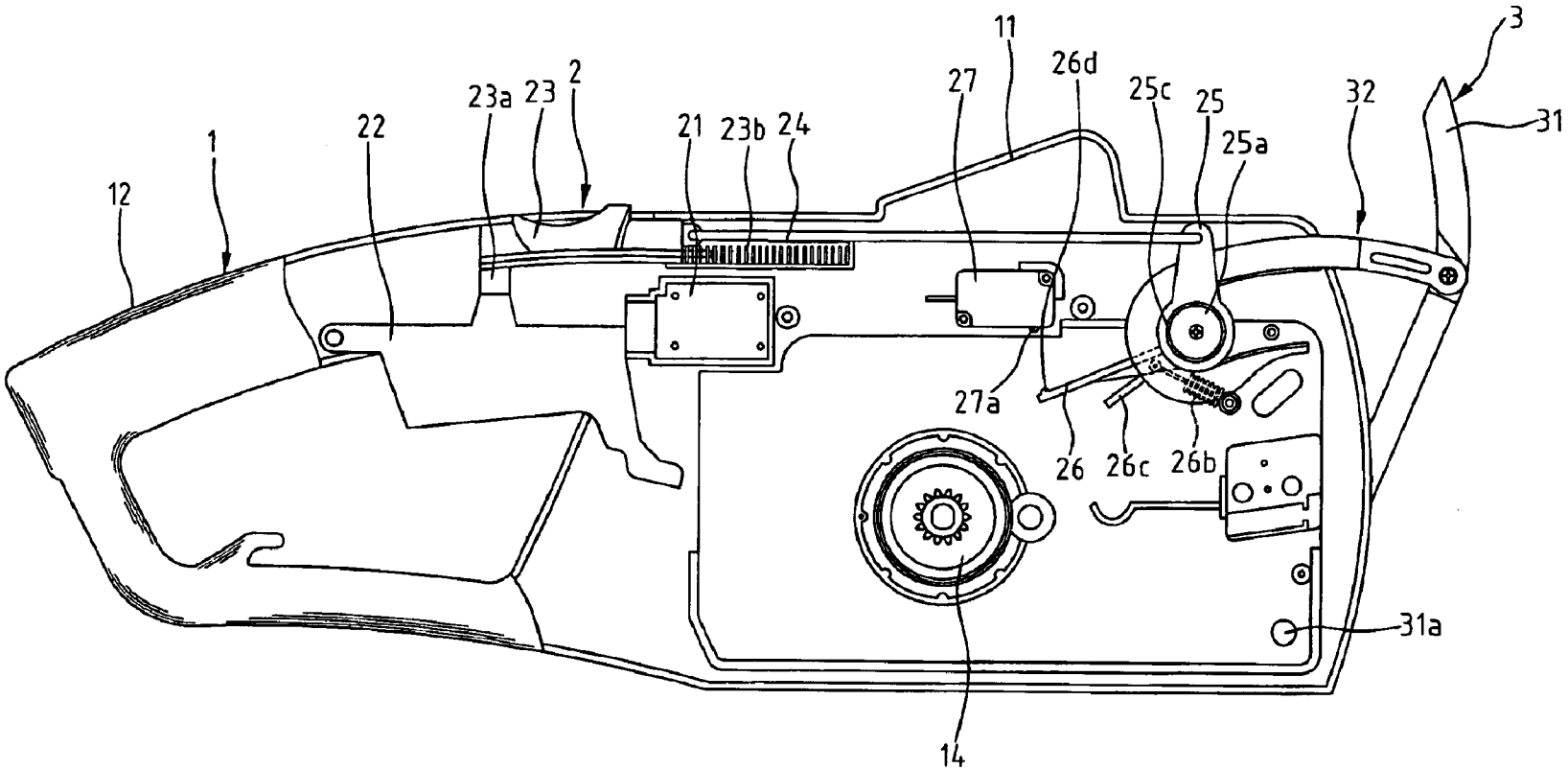
FIG. 3 is a side view to show the safety device in accordance with the present invention in the casing of the electric tool.

Referring to the drawings and in particular to FIGS. 1–3 and 5, a safety device for an electric tool includes a casing 1 which includes a handle 12 an one end and a transverse bar 11 extends from a side of the casing 1. A trigger 2 has one end pivotably connected to the handle 12 and can be pivoted to activate a first switch 21 by a front end of the trigger 22. A safety device 2 having a safety button 23 which is movably connected to the casing 1 and has a protrusion 23*a* extending from an underside thereof so as to contact a convex on a top of the trigger 22 so that the trigger 2 being stopped by the protrusion 23*a* if the safety button 23 is not shifted. The safety button 23 includes a board that extends from the safety button 23 and is biased by a spring 23*b* that is retained in a chamber. By the spring 24, the safety button 23 is maintained at the position s shown in FIG. 3. A push rod 24 has a fist end connected to the safety button 23 and the other end of the push rod 24 is pivotably connected to pivotal member 25 that has a ridge 25*b* extending from a surface thereof.

A rotatable member 26 is pivotably connected to an inside of the casing 1 and has an arm 26*d* extending from the rotatable member 26. A second switch 27 such as a limit switch is connected to the casing 1 and the arm 26*d* activates a contact point 27*a* of the second switch 27 when the rotatable member 26 is rotated. The initial position of the rotatable member 26 is restrained by a flange 26*c* in the casing 1. A groove 26*a* is defined in a surface of the rotatable member 26 and sized to receive the ridge 25*b* of the pivotal member 25. A spring 25*c* is connected to the other surface of the pivotal member 25 by a screw 25*a* so as to push the pivotal member 25 toward the rotatable member 26. A spring 26*b* has one end connected to the arm 26*d* of the rotatable member 26 and the other end of the spring 26*b* is fixed to the casing 1 so as to maintain the arm 26*d* at a distance from the second switch 27.

Figure 4:
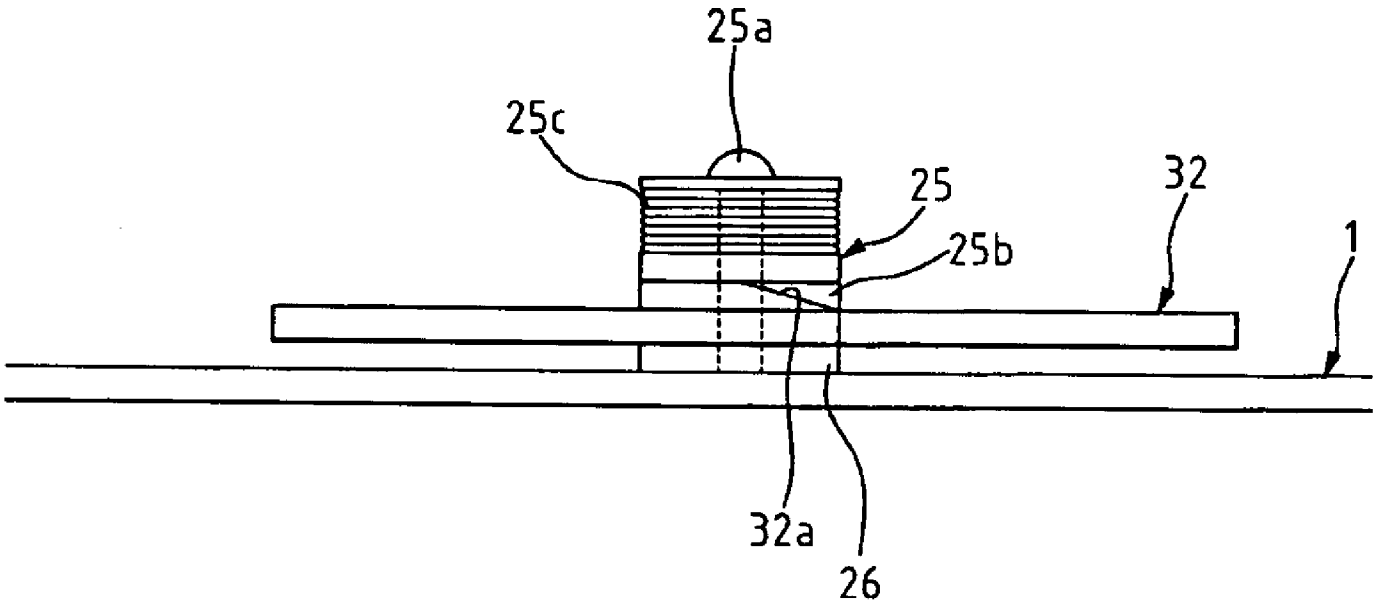
FIG. 4 shows the pivotal member is separated from the rotatable member by the inclined surface of the intermediate member.
Figure 5:
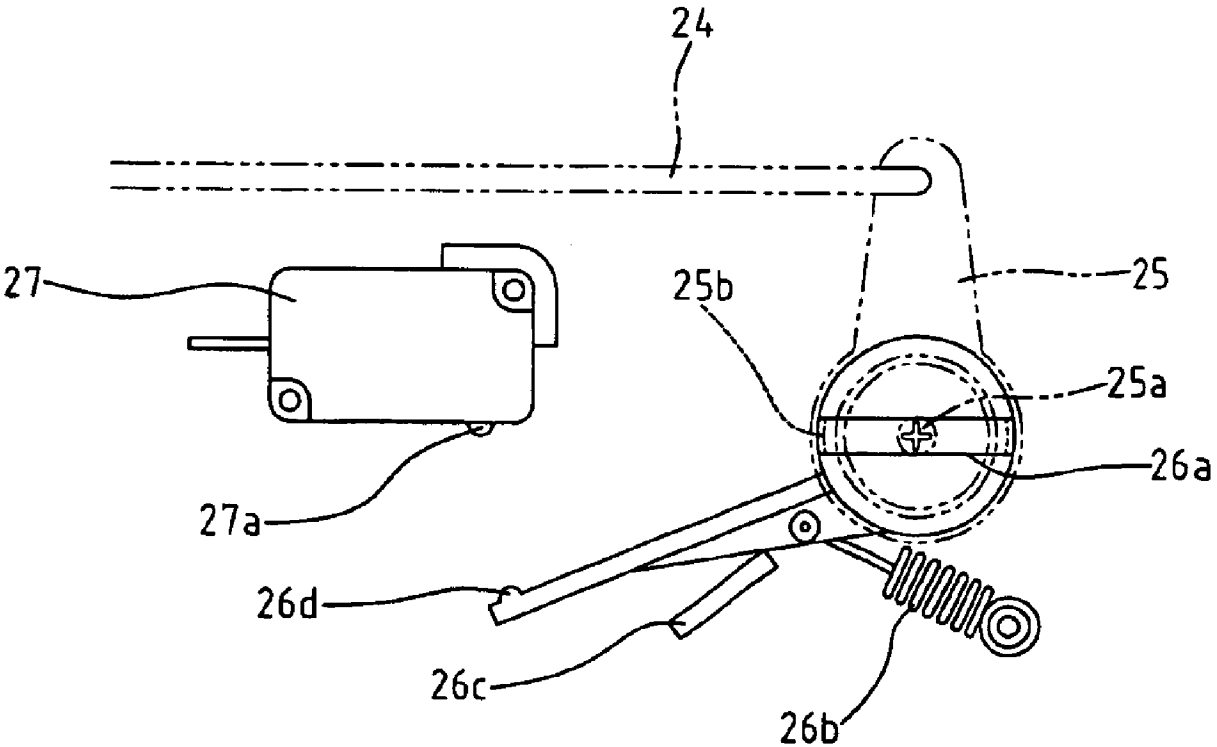
FIG. 5 shows the arm of the rotatable member is pulled by a spring and the pivotal member is connected to a push rod.
Figure 7:
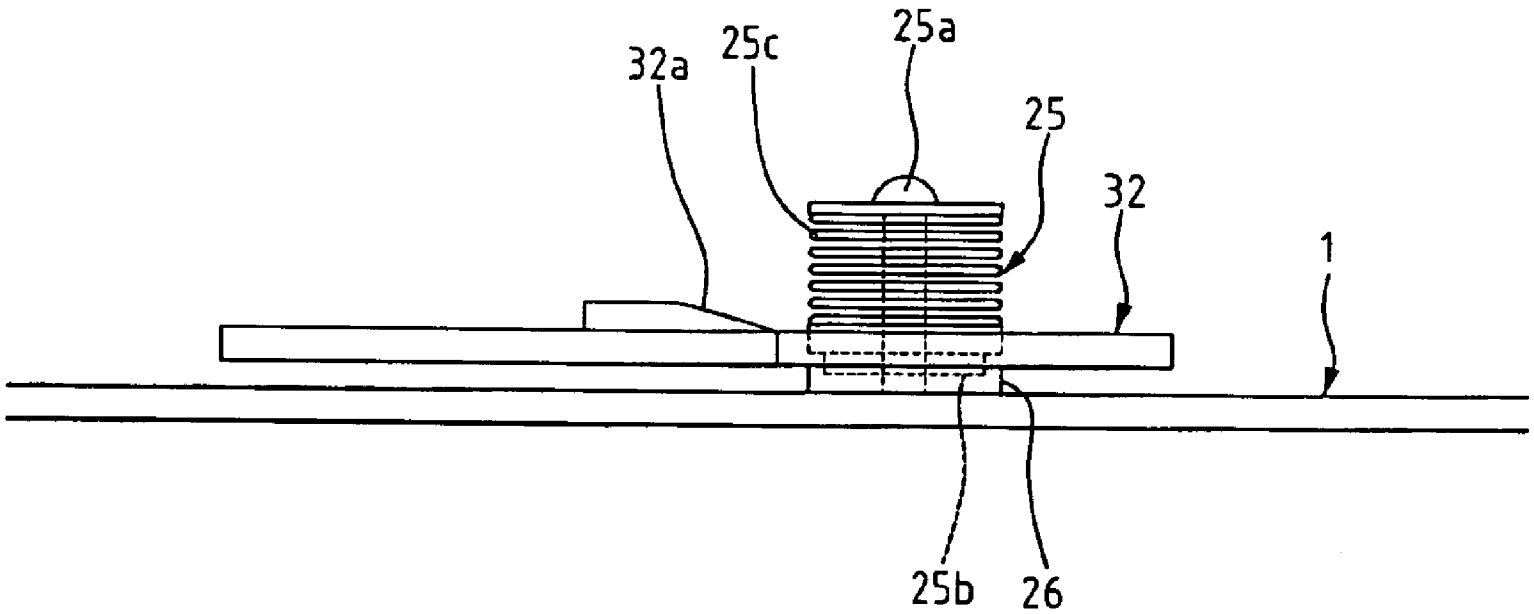
FIG. 7 shows that the ridge on the pivotal member is engaged with a groove in the rotatable member when the inclined surface of the intermediate member is shifted.

An intermediate member 32 is sandwiched between the pivotal member 25 and the rotatable member 26. An end of the intermediate member 32 is connected to a brake board 31 of a brake device 3 which has a shaft 31*a* rotatably extends in the casing 1. The output shaft 14 is stopped by pulling the brake board 31. An inclined surface 32*a* is defined in a surface of the intermediate member 32 and the pivotal member 25 is pressed on the inclined surface 32*a* as shown in FIG. 4. If the inclined surface 32*a* of the intermediate member 32 is shifted relative to the pivotal member 25 when the brake device 3 is pivoted, the ridge 25*b* of the pivotal member 25 can be engaged with the groove 26*a* of the rotatable member 26 as shown in FIG. 7. The intermediate member 32 further includes a hook portion on which the pivotal member 25 is supported.

Figure 6:
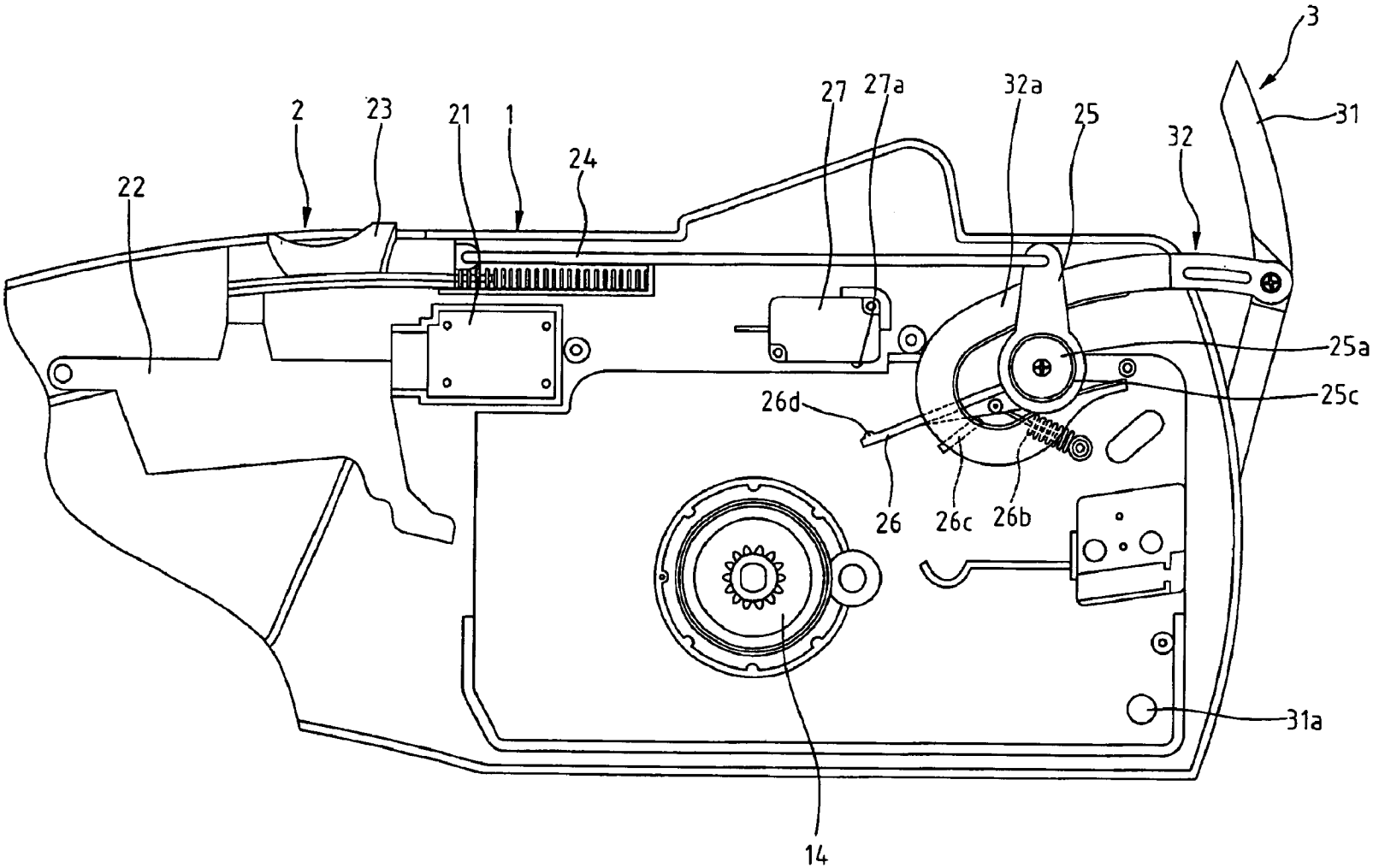
FIG. 6 shows that the intermediate member is shifted by pulling the brake device.
Figure 8:
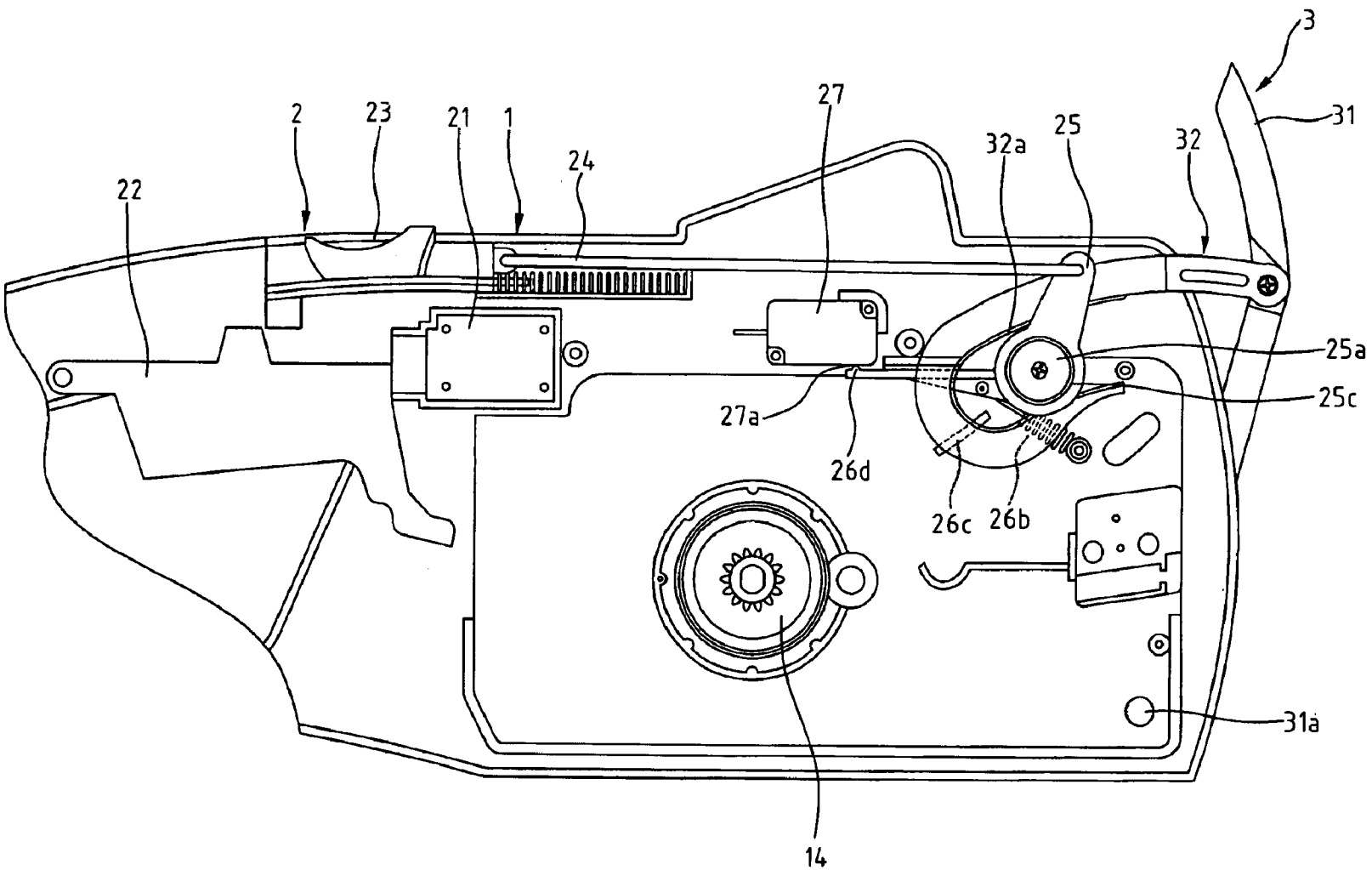
FIG. 8 shows that the pivotal member is pivoted to rotate the rotatable member, which activates the second switch, by its arm.

As shown in FIGS. 6 and 7, when operating the tool, the brake board 31 is pulled to shift the inclined surface 32*a* away from the pivotal member 25, the spring 25*c* then pushes the pivotal member 25 and the ridge 25*b* is engaged with the groove 26*a* of the rotatable member 26. The safety button 23 is then pushed and the push rod 24 rotates the pivotal member 25. The rotatable member 26 connected to the pivotal member 25 is then rotated to touch the contact point 27*a* as shown in FIG. 8. The user then pulls the trigger 22 to activate the first switch 21 that is an auto-reverse switch, the power is provided to the output shaft 14.

Figure 9:
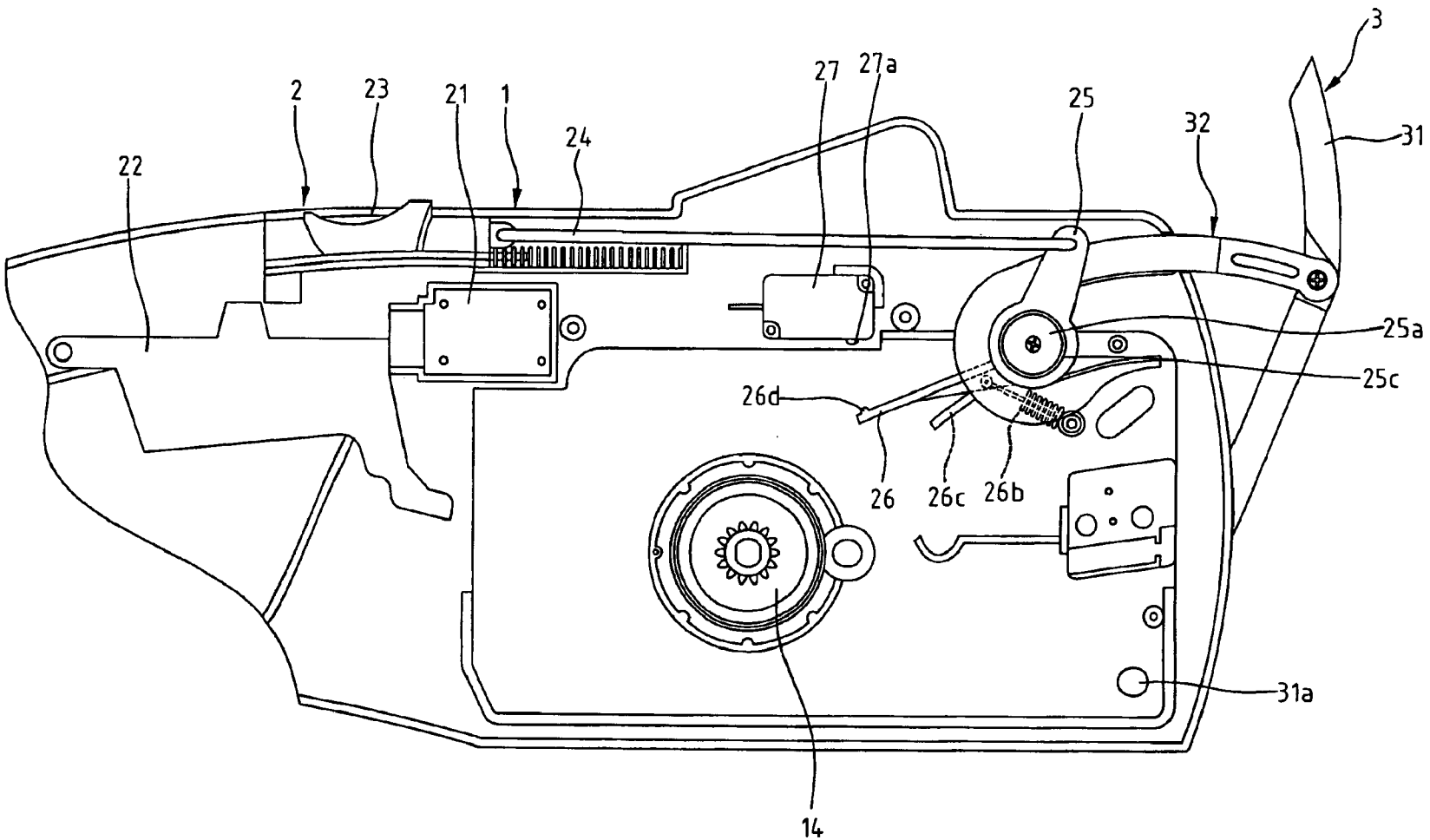
FIG. 9 shows that the pivotal member is pivoted while the rotatable member is remained still if the brake device is not pulled.
Figure 10:
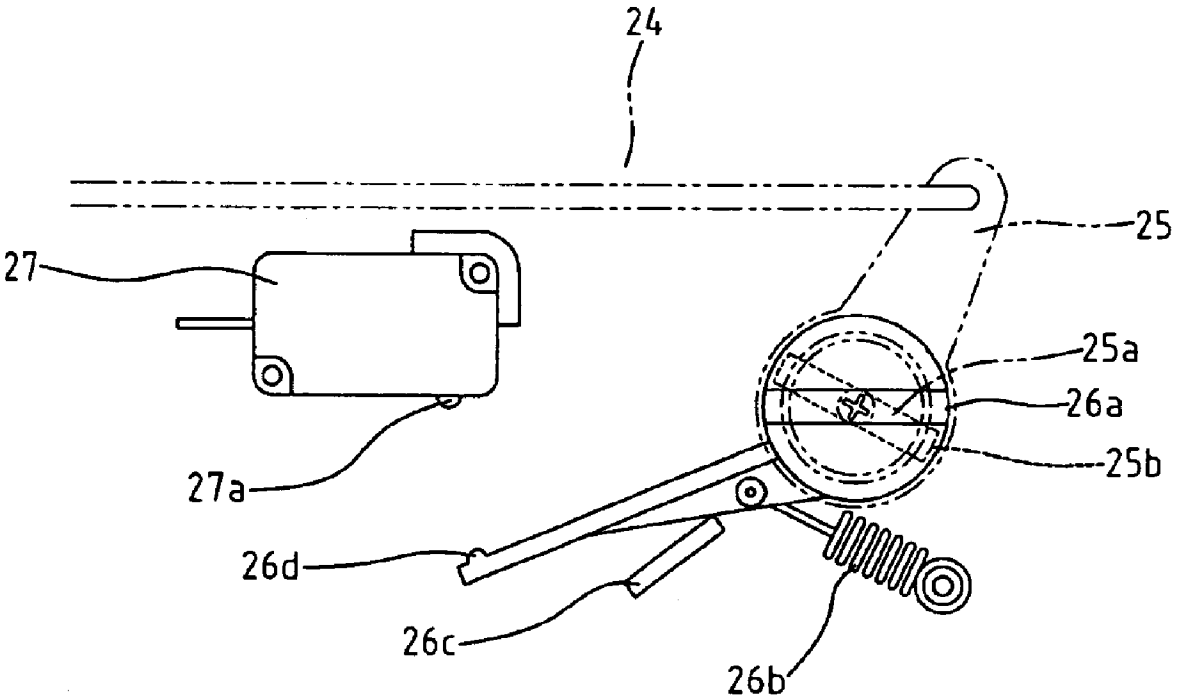
FIG. 10 shows that the pivotal member is pivoted while the rotatable member is remained still, the ridge on the pivotal member is rotated an angle and cannot be engaged with the groove in the rotatable member.
Figure 11:
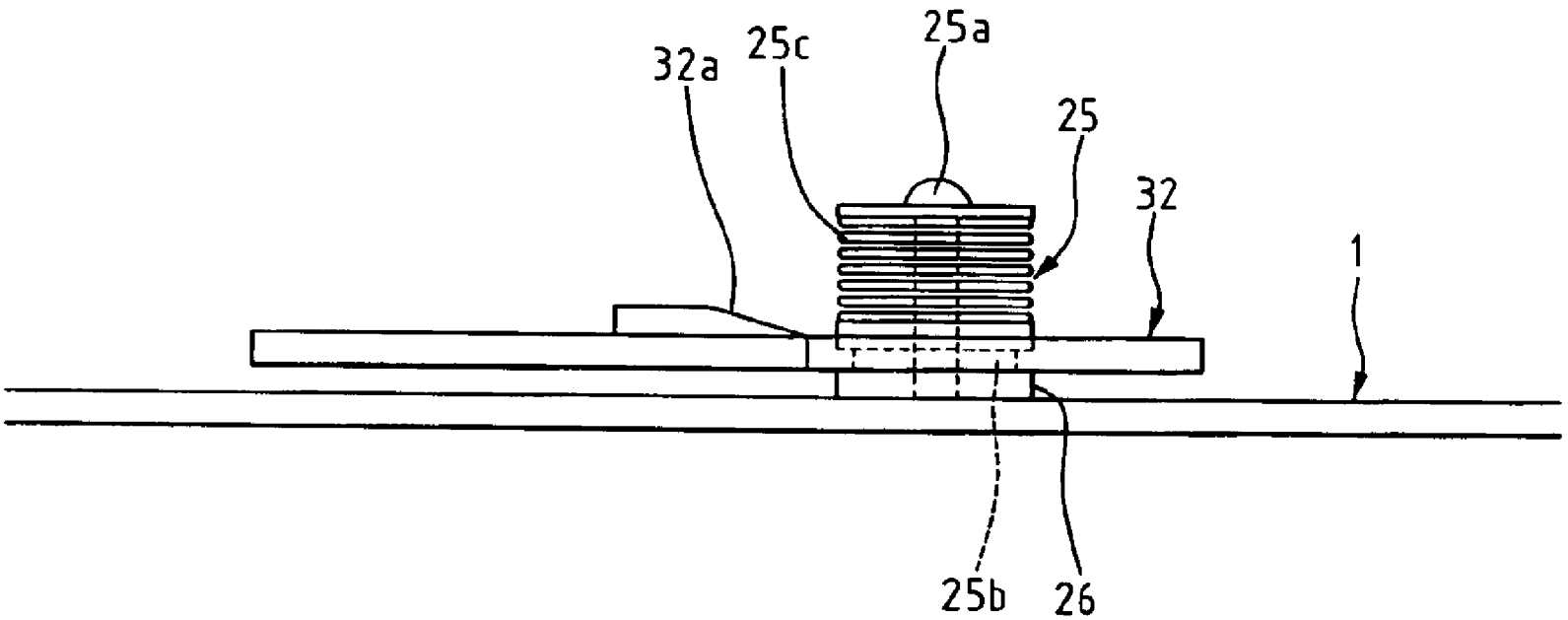
FIG. 11 shows that in the status as shown in FIG. 10, if the brake device is pulled, the ridge cannot be engaged with the groove.

As shown in FIGS. 9 and 10, if the user shifts the safety button 23 without pulling the brake board 31, the push rod 24 rotates the pivotal member 25, because the inclined surface 32*a* of the intermediate member 32 is not shifted, so that the ridge 25*b* is not engaged with the groove 26*a* and the rotatable member 26 is not rotated and the second switch 27 is not activated. Therefore, the tool cannot be activated even if the trigger 22 is pulled. As shown in FIG. 11, if the brake board 31 is then pulled, because the ridge 25 is rotated an angle so that even if the inclined surface 32*a* is shifted, the ridge 25 cannot be engaged with the groove 26*a*.

While we have shown and described the embodiment in accordance with the present invention, it should be clear to those skilled in the art that further embodiments may be made without departing from the scope of the present invention.

What is claimed is:

1. A safety device for an electric tool that includes a casing having a handle, a power source device connected to the casing, an output shaft electrically connected to the power source device, the safety device comprising:

a trigger pivotably connected to the handle and a first switch received in the casing and activated by the trigger;

a safety button movably connected to the casing and having a protrusion extending from an underside thereof, the trigger being stopped by the protrusion, a push rod having a first end connected to the safety button and the other end of the push rod a pivotably connected to pivotal member which has a ridge extending from a surface thereof, a rotatable member pivotably connected to an inside of the casing and having an arm extending from the rotatable member, a groove defined in a surface of the rotatable member and sized to receive the ridge of the pivotal member, a spring connected to an another surface of the pivotal member so as to push the pivotal member toward the rotatable member, a second switch connected to the casing and the arm activating the second switch when the rotatable member is rotated, and an intermediate member sandwiched between the pivotal member and the rotatable member, an inclined surface defined in a surface of the intermediate member and the pivotal member being pressed on the inclined surface, an end of the intermediate member connected to a brake device which is pivotably connected to the casing and to brake the output shaft, the inclined surface of the intermediate member is shifted relative to the pivotal member when the brake device is pivoted, the ridge of the pivotal member being engaged with the groove of the rotatable member when the inclined surface of the intermediate member is shifted away from the pivotal member.

2. The safety device as claimed in claim 1, wherein the safety button includes a board that is biased by a spring that is retained in a chamber.

3. The safety device as claimed in claim 1, wherein the intermediate member includes a hook portion on which the pivotal member is supported.

4. The safety device as claimed in claim 1 further comprising a spring connected to the arm of the rotatable member so as to maintain the arm at a distance from the second switch.

* * * * *